US005718283A

United States Patent [19]

Naty et al.

[11] Patent Number: 5,718,283

[45] Date of Patent: Feb. 17, 1998

[54] PROTECTIVE SCREEN FOR A VEHICLE HEAT EXCHANGER

[75] Inventors: Jean-Claude Naty, Argenteuil; Gilles Caumel, Savigny-Sur-Orge, both of France

[73] Assignee: Valeo Thermique Moteur, Le Mesnil-Saint-Denis, France

[21] Appl. No.: 686,684

[22] Filed: Jul. 26, 1996

[30] Foreign Application Priority Data

Jul. 27, 1995 [FR] France ..... 95 09176

[51] Int. Cl.[6] ..... F28F 19/01; B60R 19/52

[52] U.S. Cl. ..... 165/119; 165/134.1; 180/68.6

[58] Field of Search ..... 165/119, 134.1; 180/68.6

[56] References Cited

U.S. PATENT DOCUMENTS

| | | | |
|---|---|---|---|
| 1,399,859 | 12/1921 | Garver | 165/134.1 X |
| 1,496,661 | 6/1924 | Dreier | 180/68.6 |
| 1,571,354 | 2/1926 | Whitacre | 165/134.1 X |
| 1,755,560 | 9/1930 | Kalenoff . | |
| 1,811,527 | 6/1931 | Young | 180/68.6 |
| 2,236,986 | 4/1941 | Beeman et al. . | |
| 2,263,357 | 11/1941 | Hanson | 180/68.6 |
| 2,340,982 | 2/1944 | Patterson . | |
| 4,836,598 | 6/1989 | Mastin | 180/68.6 X |

FOREIGN PATENT DOCUMENTS

| | | |
|---|---|---|
| 2 475 122 | 8/1981 | France . |
| 2 708 312 | 2/1995 | France . |

*Primary Examiner*—Allen J. Flanigan
*Attorney, Agent, or Firm*—Morgan & Finnegan, LLP

[57] ABSTRACT

A protective screen, to act as a filter for the air stream passed through a heat exchanger in a vehicle, especially a heavy goods vehicle, comprises a cover which is pervious to air and which is arranged to be disposed facing the heat exchanger and in the path of the air stream towards the latter. The cover has a first side edge adapted to be fixed to the vehicle by detachable fastening means, and a second side edge on the side opposite the first side edge. The second side edge is arranged to be fixed to the vehicle by detachable fastening means in the form of springs, which are such as to put the screen under tension.

12 Claims, 1 Drawing Sheet

PROTECTIVE SCREEN FOR A VEHICLE HEAT EXCHANGER

FIELD OF THE INVENTION

This invention relates to heat exchangers for vehicles, especially heat exchangers for heavy goods vehicles or industrial vehicles, and to protective screens for such heat exchangers and the like. More particularly, the invention relates to a protective heat exchanger air filter screen which is provided with a cover in the form of a grid or grille (which expressions are to be read broadly, meaning that the cover has a multiplicity of small apertures through which air can pass), which is adapted to be disposed in facing relationship to the heat exchanger in the path of a stream of air passing through the latter.

Such a screen or cover constitutes a filter for retaining various pollutants such as mud, dust, sand, insects and so on, which can be carried by the airstream and which tend to be deposited in the body of the heat exchanger. Unless such pollutants are prevented from reaching the heat exchanger, the thermal performance of the latter is thereby reduced.

BACKGROUND OF THE INVENTION

Such a protective screen is generally disposed in facing relationship with a first heat exchanger, such as a cooling radiator for the engine of the vehicle. In some cases a second heat exchanger, for example a cooler for supercharging air in the case where the engine of the vehicle is provided with a turbo compressor, may be attached to the engine cooling radiator.

It has previously been proposed to employ, as a heat exchanger air filter, a fixed screen in the form of a grille, which is typically fixed at four corners on the heat exchanger or on the structure of the vehicle. However, since such a screen has to be cleaned from time to time, this known arrangement is not satisfactory, to the extent that removal of the screen occupies some time, and this increases the time during which the vehicle cannot be used.

It is also known, from the specification of French patent application No. 93 09247, to employ a protective screen in the form of a flexible roller blind, which is mounted on a roller device, with a cleaning device being provided for automatically cleaning the flexible blind while it is being rolled up or unrolled by the rolling device. This known type of arrangement does offer satisfaction, but it calls for a complex structure.

DISCUSSION OF THE INVENTION

A main object of the invention is to overcome the above mentioned drawbacks.

According to the invention, a protective filter screen for a vehicle heat exchanger, of the type comprising a cover of generally grid or grille form is adapted to be disposed facing the heat exchanger in the path of an air stream passing through the latter. The heat exchanger is characterised in that the cover has a first side edge which is adapted to be fixed to the heat exchanger, or another part of the vehicle, by detachable first fastening means. The cover also has a second side edge opposite to the first side edge, the screen being adapted to be fixed to the heat exchanger, or another part of the vehicle, by detachable second fastening means in the form of springs, to maintain the protective screen under tension.

Thus the filter screen can easily be fitted in place by the detachable fastening means, some of which constitute springs, and this enables the cover to be put into tension at the same time. Similarly, its removal is particularly easy, in particular with a view to its maintenance and cleaning.

In a preferred embodiment of the invention, the first fastening means comprise two retaining noses which are adapted to be engaged in two retaining hooks connected to the vehicle.

The two retaining noses are preferably formed at the two ends of a rigid hem element which extends along the first side edge of the cover.

According to a preferred feature of the invention, each of these two retaining hooks (associated with the first side edge) has an aperture which faces away from the second side edge of the cover. As a result of this, under the influence of the springs, the retaining noses tend to engage in the retaining hooks and to stay in position.

In this preferred embodiment of the invention, the retaining hooks are preferably formed on a fluid header of the heat exchanger itself. By way of example, these retaining hooks may be made integrally with the header by moulding, the latter being preferably made of a suitable plastics material.

The invention is applicable in particular to a heat exchanger which also includes a further fluid header at the opposite end of the heat exchanger from the above mentioned first header. In that case, according to another preferred feature of the invention, further retaining hooks may also be provided on this header to provide another means for fastening the protective screen.

In preferred embodiments of the invention, the second fastening means comprise at least two tension springs, each of which has one end which is adapted to be fixed to the second side edge of the cover that constitutes the protective screen, and another end which is adapted to be fixed to an attachment element carried by the vehicle.

Each spring preferably includes a hook which is adapted to be engaged in a hole formed in a rigid hem element extending along the second side edge of the cover, together with another hook at the other end of the spring, this other hook being adapted to be engaged in a hole of the above mentioned attachment element fixed to the vehicle.

The protective screen, in the form of a cover constituting a grid or grille according to the invention, may be made from different materials, to constitute a kind of sieve or strainer, having a mesh or holes of predetermined size for retaining those pollutants which would otherwise enter the heat exchanger. In one preferred embodiment of the invention, the cover is in the form of a curtain woven from glass fibres coated with polyvinyl chloride (pvc).

The first side edge and the second side edge are each preferably provided with a rigid hem element which is, for example, formed by bending back or folding a strip of metal.

The cover is typically of generally rectangular form, so that it also has two further side edges. Each of these further side edges may be provided with a flexible hem element, which is preferably of plastics material and which is adhesively bonded on the cover.

Further features and advantages of the invention will appear more clearly on a reading of the following description of a preferred embodiment of the invention, which is given by way of example only and with reference to the accompanying drawings.

DESCRIPTION OF A PREFERRED EMBODIMENT OF THE INVENTION

Figure 1:
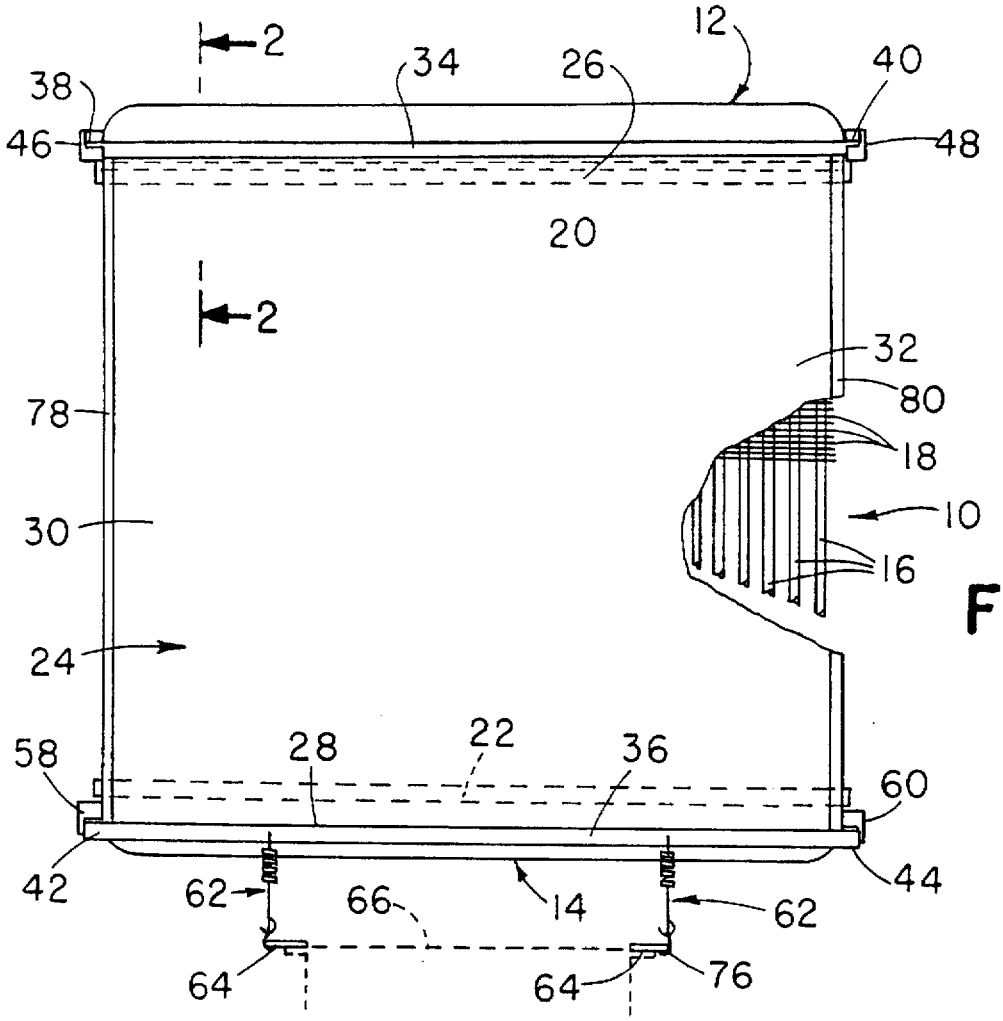
FIG. 1 is a view in elevation, shown partly cut away, of a heat exchanger having a protective screen in accordance with the invention.

Reference is first made to FIG. 1, which shows a heat exchanger 10. In this example this heat exchanger is a radiator for cooling the engine of a motor vehicle, in particular a heavy goods vehicle.

The heat exchanger 10 has two fluid headers, namely an upper fluid header 12 which is located at the top, and a lower fluid header 14 at the bottom of the radiator. The headers 12 and 14 are connected together through a large number of tubes 16 arranged in a bundle, with the tubes extending through a matrix consisting of a large number of cooling fins 18. The ends of the tubes 16 are joined to the upper header 12 through a header plate 20, and to the lower header 14 through another header plate 22.

The fluid which passes through the radiator, so as to be cooled, is a heat transfer fluid which is for example water containing a suitable antifreeze compound. This fluid enters the heat exchanger through an inlet tube branch and leaves it through an outlet tube branch. These two tube branches, which are not shown, may both be arranged on a single one of the two headers, or alternatively on both headers, in the manner well known in the art.

The heat exchanger 10 is provided with a protective filter screen which comprises a cover 24 in the form of a grid or grille, or in more general terms pervious to air. This cover 24 is disposed facing the heat exchanger, and more particularly facing the bundle of finned tubes, in the path of an air stream which is arranged to pass through the heat exchanger, that is to say to impinge on the finned tubes of the bundle. In the example shown in the drawings, the cover 24 is placed in front of the heat exchanger 10, with reference to the drawing in FIG. 1.

The cover 24 is a flexible cover of generally rectangular shape, having a first or upper side edge 26 disposed on the same side as the upper header 12, together with a second or lower side edge 28 opposite to the side edge 26 and situated on the same side as the lower header 14. The cover 24 also has two further opposed side edges 30 and 32. The cover 24 is formed of a material in grid form, or perforated, which defines a meshed structure. In this example, the cover consists of a curtain woven in glass fibres coated with pvc. Also in this example, this weave is formed from threads having a diameter of 0.20 mm, with a mesh aperture of 1.3×1.53 mm.

The upper side edge 26 is provided with a rigid hem element 34 formed from a metallic strip which is bent back on itself and adhesively bonded to the cover 24. By way of example, a strip of aluminium having a thickness of 0.8 mm can be used, folded into four thicknesses. Similarly, the second or lower side edge 28 has a similar rigid hem element 36. The form taken by this rigid hem element 36 is seen best in the upper part of FIG. 1. The rigid upper hem element 34 extends over a length which is greater than that of the upper side edge 26, so as to define two retaining noses 38 and 40 which project beyond the edges 30 and 32 of the cover. Similarly, the hem element 36 has two retaining noses 42 and 44 which again project beyond the two edges 30 and 32 of the cover.

The retaining noses 38 and 40 are arranged to engage in two retaining hooks 46 and 48 respectively, which in this example are formed integrally by moulding with the upper fluid header 12.

Figure 2:
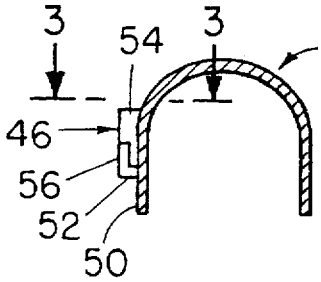
FIG. 2 is a view on a larger scale, in transverse cross section taken on the line II—II in FIG. 1.
Figure 3:
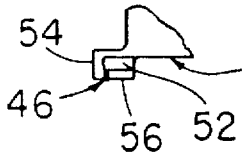
FIG. 3 is a top plan view a portion of to FIG. 2 showing, when viewed in the direction of the arrows III—III of FIG. 2, a retaining hook.
Figure 4:
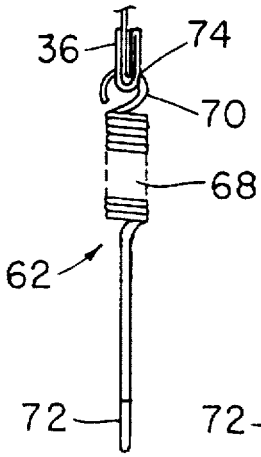
FIG. 4 is a view in elevation showing one of the fastening springs.
Figure 5:
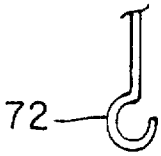
FIG. 5 is a side view of one of the two hooks of the spring of FIG. 4.

The structure of the retaining hook 46 will now be described with reference to FIGS. 2 and 3. The hook 46 is formed integrally by moulding with the header wall 50 of the upper header 12. The wall 50 has a U-shaped profile. The hook 46 is made in the form of an open seating adapted to receive the retaining nose 38. This seating is delimited by a base wail 52 which is attached at right angles to the wall 50 and which extends parallel to the direction of the hem element 34 (see FIG. 3). The seating is also delimited by a side wall 54 which is attached at right angles to the wall 50 of the header and at right angles to the base wall 52. In addition, the seating is delimited by an anterior wall 56 which extends parallel to the wall 50 and which joins the walls 52 and 54 together. The said seating thus defines an aperture which is directed upwardly and therefore away from the opposite side edge 28 of the cover.

The retaining hook 48 has a structure symmetrical with that of the hook 46.

As can also be seen in FIG. 1, the lower fluid header 14 has two retaining hooks 58 and 60 similar to the hooks 46 and 48 and disposed in the region of the retaining noses 42 and 44. In fact, the hooks 58 and 60 are not adapted to cooperate with the noses 42 and 44 in this embodiment, but are intended to provide another fastening means if desired, as mentioned later herein.

The second side edge 28 of the cover is connected through two traction hooks 62 to two attachment elements 64, which may for example be of aluminium. These attachment elements 64 are fixed to a support 66, which is shown in broken lines and which in this example form part of the structure of the vehicle itself. Each of the traction springs 62 is made from a wire which is formed into a helical body 68, the turns of which are in contact with each other, and which is extended by two opposed hooks 70 and 72. The hook 70 is arranged to engage in a hole 74 which is formed within the thickness of the hem element 36, while the hook 72 is arranged to engage in a hole 76 (FIG. 1) of the attachment element 64.

As can again be seen in FIG. 1, the side edges 30 and 32 are here provided with a flexible hem element 78, 80 respectively, which is preferably made of a suitable plastics material adhesively bonded on the cover 24.

In order to fit the protective screen in position, it is merely necessary to engage the retaining noses 38 and 40 in the retaining hooks 46 and 48, and then to pull on the springs 62, in such a way as to separate their respective turns from each other and to enable the hooks 72 to engage in the holes 64 of the attachment elements, or lugs, 64. The cover 24 is then held under tension in the position shown in FIG. 1. In this position, the retaining noses 42 and 44 are not engaged in the retaining hooks 58 and 60. These latter could be used in another fastening mode. The fastening lugs 64 would then be provided on the same side as the upper header 12.

For removal of the protective screen 24, it is merely necessary to pull on the springs 62 in order to disengage the hooks 72 from the attachment lugs 64, so enabling the retaining noses 38 and 40 to be disengaged from their respective retaining hooks 46 and 48. The cover 24 can then be taken away, and easily cleaned, before being replaced in accordance with the procedure described above.

The invention is of course not limited to the embodiment described above by way of example, and it is possible to provide other versions, especially as regards the structure of the protective screen or cover and the detachable fastening means for the latter.

What is claimed is:

1. A combination in a vehicle, a heat exchanger of the vehicle and a protective screen for the heat exchanger, the heat exchanger being adapted for flow of a stream of air through it and the protective screen for filtering said air, the screen comprising a cover pervious to air, the heat exchanger and the cover defining detachable first and second fastening means for the removable attachment of the cover directly to the heat exchanger with the cover facing the heat exchanger in the path of said air stream, wherein the cover defines a first side edge and a second side edge opposite to said first side edge, the first fastening means having first fastening elements carried by the cover at its first side edge and second fastening elements carried by the heat exchanger, the vehicle having further fastening elements, and the second fastening means having said further fastening elements and springs carried by the cover at its second side edge for engagement with the further fastening elements, the springs being tension springs whereby to put the cover into tension.

2. A combination according to claim 1, wherein the first fastening elements comprise retaining noses, the second fastening elements being retaining hooks fixed with respect to the vehicle.

3. A combination according to claim 2, wherein the screen further includes a rigid hem element extending along its first side edge, the hem element defining the retaining noses.

4. A combination according to claim 2, wherein each said retaining hook defines an aperture which is open in a direction away from the second side edge of the cover.

5. A combination according to claim 2, in which the heat exchanger has a fluid header, and wherein the retaining hooks are carried by the fluid header.

6. A combination according to claim 5, wherein the retaining hooks are formed integrally by molding with the header.

7. A combination in a vehicle, a heat exchanger of the vehicle and a protective screen for the heat exchanger, the heat exchanger being adapted for flow of a stream of air through it and the protective screen for filtering said air, the screen comprising a cover pervious to air, the heat exchanger and the cover defining detachable first and second fastening means for the removable attachment of the cover to the vehicle with the cover facing the heat exchanger in the path of said air stream, wherein the cover defines a first side edge and a second side edge opposite to said first side edge, the first fastening means having first fastening elements carried by the cover at its first side edge and second fastening elements carried by a part of the vehicle, the vehicle having further fastening elements, and the second fastening means having said further fastening elements and springs carried by the cover at its second side edge for engagement with the further fastening elements, the springs being tension springs whereby to put the cover into tension, wherein the first fastening elements have retaining noses, the second fastening elements being retaining hooks fixed with respect to the vehicle, in which the heat exchanger has a fluid header, and wherein the retaining hooks are carried by the fluid header, wherein the heat exchanger further includes another fluid header, the other fluid header having further retaining hooks.

8. A combination according to claim 1, having at least two tension springs, each spring having a first end portion for attachment to the second side edge of the cover, and a second end portion for attachment to the further fastening element of the vehicle.

9. A combination according to claim 8, wherein the cover further includes a rigid hem element extending along the second side edge of the cover and defining holes therein, each further fastening element of the vehicle having a further hole, the first end portion of each spring having a first hook for engagement in at least one of the hem element holes and the second end portion having a further hook for engaging at least one of the further fastening element holes.

10. A combination according to claim 1, wherein the cover is a curtain of woven glass fiber coated with PVC.

11. A combination according to claim 1, wherein each of the cover side edges further comprise a rigid hem element having a folded metallic strip.

12. A combination according to claim 1, wherein the cover further comprises two opposed third side edges, and a flexible hem element adhesively bonded along each of the third side edges.

* * * * *